US009694620B2

(12) United States Patent
Chu

(10) Patent No.: US 9,694,620 B2
(45) Date of Patent: Jul. 4, 2017

(54) RESERVOIR TYPE WRITING PEN HAVING MICRO-POROUS STRAIGHT-LIQUID STRUCTURE

(71) Applicant: TUNG YIK INTERNATIONAL LTD., Hong Kong (HK)

(72) Inventor: Xiangwei Chu, Hong Kong (HK)

(73) Assignee: TUNG YIK INTERNATIONAL LTD., Hong Kong (HK)

( * ) Notice: Subject to any disclaimer, the term of this patent is extended or adjusted under 35 U.S.C. 154(b) by 74 days.

(21) Appl. No.: 14/813,122

(22) Filed: Jul. 30, 2015

(65) Prior Publication Data

US 2017/0001465 A1 Jan. 5, 2017

(30) Foreign Application Priority Data

Jul. 2, 2015 (CN) ..... 2015 2 0468796 U

(51) Int. Cl.

*B43K 8/03* (2006.01)
*B43K 8/08* (2006.01)
*B43K 8/06* (2006.01)

(52) U.S. Cl.

CPC ..... *B43K 8/03* (2013.01); *B43K 8/06* (2013.01); *B43K 8/08* (2013.01)

(58) Field of Classification Search

CPC ..... B43K 8/04; B43K 8/06; B43K 8/08
See application file for complete search history.

(56) References Cited

U.S. PATENT DOCUMENTS 5,865,553 A * 2/1999 Flye Sainte Marie ... B43K 8/04 401/142
6,503,017 B1 * 1/2003 Liu ..... B43K 8/08 401/199
6,637,965 B1 * 10/2003 Harder ..... B43K 8/06 401/198
2001/0016141 A1 * 8/2001 Kaufmann ..... B43K 8/04 401/198
2002/0057940 A1 * 5/2002 Kaufmann ..... B43K 8/06 401/198
2005/0276654 A1 * 12/2005 Choi ..... B43K 8/04 401/199
2007/0212159 A1 * 9/2007 Kurita ..... B43K 8/04 401/199
2008/0063463 A1 * 3/2008 Hori ..... B43K 8/04 401/196

(Continued)

*Primary Examiner* — Jennifer C Chiang
*Assistant Examiner* — Bradley Oliver

(57) ABSTRACT

A reservoir type writing pen having a micro-porous straight-liquid structure comprises a writing pen core (9); wherein the micro-porous straight-liquid structure includes an air pressure balance plug (3), a liquid storage pipe (11) configured for storing liquid ink, and a liquid guiding device configured for leading the liquid ink in the liquid storage pipe (11) into the writing pen core (9). The present application adopts the gap between the relaying pen core and the writing pen core, the ventilating core and the nano breathing plate to realize keeping the inner air pressure of the liquid storage space and the outside atmosphere pressure consistent. The writing pen of the present application has a simple structure, and the producing processes of the ventilating core have been matured, which can reduce the producing cost greatly.

17 Claims, 6 Drawing Sheets

(56) References Cited

U.S. PATENT DOCUMENTS

| | | | | |
|---|---|---|---|---|
| 2012/0107036 | A1* | 5/2012 | Hui | B43K 8/08<br>401/232 |
| 2015/0063894 | A1* | 3/2015 | Wen | B43K 8/02<br>401/198 |

* cited by examiner

RESERVOIR TYPE WRITING PEN HAVING MICRO-POROUS STRAIGHT-LIQUID STRUCTURE

CROSS REFERENCE TO RELATED APPLICATIONS

The present application claims the benefit of Chinese Patent Application No. 201520468796.3 filed on Jul. 2, 2015, the contents of which are hereby incorporated by reference.

TECHNICAL FIELD

The application relates to a writing tool, and more particularly relates to a reservoir type writing pen having a micro-porous straight-liquid structure, which has a simple structure, writes smoothly and is not easy to leak.

BACKGROUND

A conventional writing pen comprises a liquid storage portion and a liquid guiding portion at least; the liquid storage portion is configured for storing liquid ink, even gel ink as a source of ink; and the liquid guiding portion leads ink to a nib for a writing purpose. As the writing pen is used, and ink is consumed, the liquid storage portion needs a supplement of air outside, in order to prevent the liquid storage portion from generating negative pressure which affects a flowing out of the ink. That is, an air flow channel should be arranged between the liquid storage portion and outside atmosphere to make the air pressure of the liquid storage portion equal to the air pressure of the outside atmosphere, which is a key technology to ensure that the writing pen writes smoothly and is not easy to leak.

In an existing technical document, a reservoir type writing pen is provided, and the writing pen adopts a dust proofing plate, a labyrinth vent plug, a nano lyophobic infiltration plate and a one-way valve to achieve a connection between the liquid storage portion and the outside atmosphere. Although the writing pen of this type can keep air pressure balance, however, the writing pen has a complex structure, comprises a lot of parts, has many assembly steps and a high cost.

In another existing technical document, a reservoir type writing pen is provided, and the writing pen adopts a nano lyophobic infiltration plate to achieve a connection between the liquid storage portion and outside atmosphere. However, the writing pen also has a complex structure, comprises a lot of parts and has many assembly steps, which is not suitable for an automatic production.

SUMMARY

The present application provides a reservoir type writing pen having a micro-porous straight-liquid structure, which has a simple structure, aiming at defects that the existing reservoir type writing pen has a complex structure, has a lot of parts and assembly steps, and is not suitable for an automatic production.

The technical solutions of the present application for solving the technical problems are as follows:

In one aspect, a reservoir type writing pen having a micro-porous straight-liquid structure is provided, which comprises a writing pen core; wherein the micro-porous straight-liquid structure includes an air pressure balance plug, a liquid storage pipe configured for storing liquid ink, and a liquid guiding device configured for leading the liquid ink in the liquid storage pipe into the writing pen core; the liquid storage pipe includes a liquid storage cylinder and a fixing cover arranged on a rear end portion of the liquid storage cylinder; the air pressure balance plug is plugged in a front end portion of the liquid storage cylinder; a first through-hole and a second through-hole are respectively defined in the air pressure balance plug; the micro-porous straight-liquid structure further includes a ventilating core with micro-pores and configured for covering a section of the entire second through-hole to keep air pressure of inside of the liquid storage pipe and that of outside of the liquid storage pipe balance; the liquid storage pipe, the air pressure balance plug and the ventilating core form a liquid storage space configured for storing the liquid ink.

The liquid guiding device includes a liquid diversion core and a relaying pen core; wherein the relaying pen core passes through the first through-hole, a rear end portion of the relaying pen core is further fixedly snapped in the fixing cover, and a front end portion of the relaying pen core is inserted in a rear end portion of the liquid diversion core, which is configured for leading the liquid ink in the liquid storage space into the liquid diversion core; the writing pen core is inserted in a front end portion of the liquid diversion core, which is configured for absorbing the liquid ink in the liquid diversion core.

In one embodiment, a gap is formed between the relaying pen core and an inner surface of the first through-hole.

In another embodiment, a section of the first through-hole is polygonal; a section of the relaying pen core is circular, and the section of the relaying pen core is inscribed in the section of the first through-hole.

In another embodiment, the reservoir type writing pen further comprises a pen cylinder, a front seat and a rear seat; the front seat is a body of revolution, and a third through-hole is further defined in the front seat axially; the rear seat is columnar; the front seat is fixed on a front end portion of the pen cylinder, and the rear seat is fixed on a rear end portion of the pen cylinder, such that the front seat, the rear seat and the pen cylinder form an accommodating space; the liquid storage cylinder is a section of the pen cylinder; the fixing cover, the air pressure balance plug, the ventilating core, the liquid guiding device and the writing pen core are mounted in the accommodating space; the writing pen core passes through the third through-hole and further extends out of the accommodating space.

In another embodiment, a first fixing recess is defined on an end surface of the rear seat located in the accommodating space, and the fixing cover is fixedly snapped in the first fixing recess.

In another embodiment, a second fixing recess is defined on an end surface of the front seat located in the accommodating space; an opening of the third through-hole is formed in the bottom of the second fixing recess, and the liquid diversion core is fixedly snapped in the second fixing recess.

In another embodiment, the reservoir type writing pen further comprises three blocking sheets, and the three blocking sheets are respectively inserted in the air pressure balance plug and resisted with the liquid diversion core.

In another embodiment, a nano breathing plate is arranged between the ventilating core and the air pressure balance plug.

In another embodiment, the ventilating core is further contacted with the liquid diversion core via the nano breathing plate.

In another embodiment, the liquid diversion core includes a core body made of cotton material and a covering element coated on the core body.

The present application adopts the gap between the relaying pen core and the writing pen core, the ventilating core and the nano breathing plate to realize keeping the inner air pressure of the liquid storage space and the outside atmosphere pressure consistent. The writing pen of the present application has a simple structure, and the producing processes of the ventilating core have been matured, which can reduce the producing cost greatly.

BRIEF DESCRIPTION OF THE DRAWINGS

The present application will be further described with reference to the accompanying drawings and embodiments in the following, in the accompanying drawings.

(Note: the section of the first through-hole that has three or more angles is authorized; the section of the first through-hole that has rounded angles having a precision equal to or more than R0.05 is authorized; the number of the circular first through-holes that is ranged from one to infinite is authorized.)

DETAILED DESCRIPTION OF THE PREFERRED EMBODIMENT

The present application will be further described with reference to the accompanying drawings and embodiments in the following.

Figure 1:
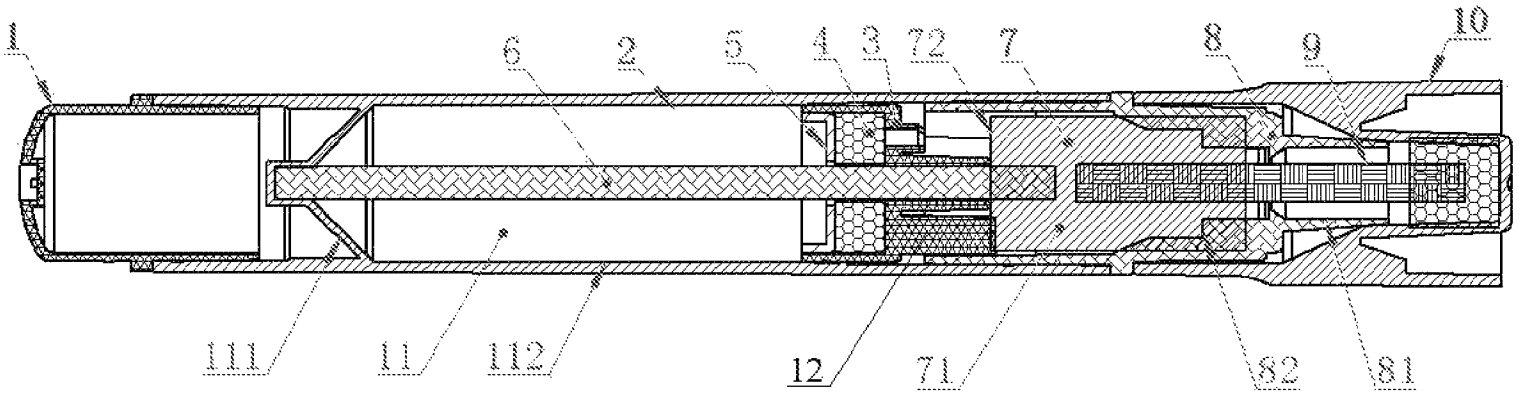
FIG. 1 is a schematic view of a reservoir type writing pen of an embodiment of the present application.
Figure 2:
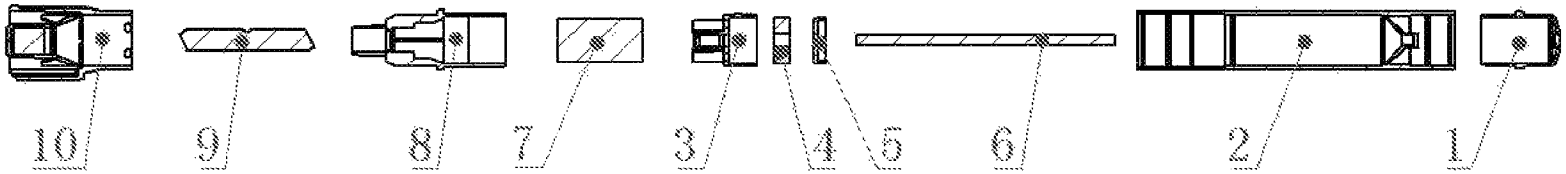
FIG. 2 is an exploded view of the reservoir type writing pen shown in FIG. 1.

As shown in FIGS. 1 and 2, FIG. 1 is a schematic view of a reservoir type writing pen of an embodiment of the present application, and FIG. 2 is an exploded view of the reservoir type writing pen shown in FIG. 1.

For convenience to describe, in the present application, a nib position of the reservoir type writing pen is defined as a front end portion of the reservoir type writing pen, and a tail position of the reservoir type writing pen is defined as a rear end portion of the reservoir type writing pen.

As shown in FIGS. 1 and 2, in the present application, the reservoir type writing pen comprises a writing pen core 9, a pen cylinder 2, a front seat 8, a rear seat 1, a pen cap 10 and a micro-porous straight-liquid structure. In this case, the micro-porous straight-liquid structure includes an air pressure balance plug 3, a liquid storage pipe 11 configured for storing liquid ink, and a liquid guiding device configured for leading the liquid ink in the liquid storage pipe 11 into the writing pen core 9.

As shown in FIG. 1, the liquid storage pipe 11 includes a liquid storage cylinder 112 and a fixing cover 111 arranged on a rear end portion of the liquid storage cylinder 112. In the present application, the liquid storage cylinder 112 is a section of the pen cylinder 2, and the fixing cover 111 is glued with the liquid storage cylinder 112. It is understood that in other embodiments, the liquid storage cylinder 112 can be a part that is independent of pen cylinder 2, and is mounted on the pen cylinder 2 by an adhesive way.

As shown in FIG. 1, the air pressure balance plug 3 is plugged in a front end portion of the liquid storage cylinder 112, wherein a first through-hole 31 and a second through-hole 32 are respectively defined in the air pressure balance plug 3. The micro-porous straight-liquid structure further includes a ventilating core 5 with micro-pores and configured for covering a section of the entire second through-hole 32 to keep air pressure of inside of the liquid storage pipe and that of outside of the liquid storage pipe 11 balance. The liquid storage pipe 11, the air pressure balance plug 3 and the ventilating core 5 form a liquid storage space configured for storing the liquid ink, wherein the liquid storage space is configured for storing liquid ink such as fluorescent ink, mark ink, whiteboard ink, blackboard ink or correction fluid.

Furthermore, the liquid guiding device includes a liquid diversion core 7 and a relaying pen core 6. In the present application, the writing pen core 9 and the relaying pen core 6 are made of fiber materials.

Furthermore, in the present application, as shown in FIG. 1, the front seat 8 is a body of revolution, and a third through-hole 81 is defined in the front seat 8 axially. The rear seat 1 is columnar. The front seat 8 is fixed on a front end portion of the pen cylinder 2, and the rear seat 1 is fixed on a rear end portion of the pen cylinder 2.

In the present application, as shown in FIG. 1, the front seat 8 and the rear seat 1 are respectively connected to the pen cylinder 2 via a threaded connection. It is understood that the connection way between the front seat 8 and the pen cylinder 2, and the connection way between the rear seat 1 and the pen cylinder 2 are not limited to the threaded connection, and can be an adhesive way, etc.

Furthermore, the front seat 8, the rear seat 1 and the pen cylinder 2 form an accommodating space. The fixing cover 111, the air pressure balance plug 3, the ventilating core 5, the liquid guiding device and the writing pen core 9 are mounted in the accommodating space. The writing pen core 9 passes through the third through-hole 81 and further extends out of the accommodating space.

In the present application, as the liquid storage cylinder 112 is a section of the pen cylinder 2, and the fixing cover 111 is fixedly connected to the pen cylinder 2, thus, the rear seat 1 is mainly configured for sealing an opening of the rear end portion of the pen cylinder 2.

Figure 11:
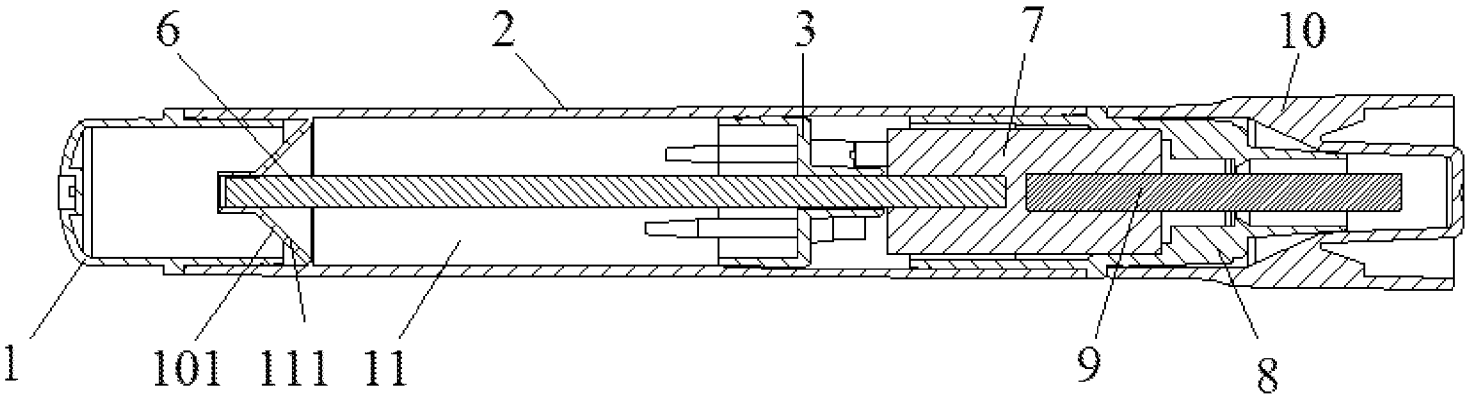
FIG. 11 is a schematic view of another embodiment of the reservoir type writing pen of the present application.

In another embodiment, as shown in FIG. 11, a first fixing recess 101 is defined on an end surface of the rear seat 1 located in the accommodating space. In this case, the shape of the fixing cover 111 is adapted to the shape of the first fixing recess 101, and the fixing cover 111 is fixed in the first fixing recess 101. Advantageously, the fixing cover 111 is in shape of a cone frustum, and the shape of the first fixing recess 101 is adapted to the shape of the fixing cover 111 and is also in shape of a cone frustum. It is understood that the shape of the first fixing recess 101 and that of the fixing cover 111 are not limited to the aforementioned shape. For example, the first fixing recess 101 and the fixing cover 111 can be in shape of a frustum or a prismatic cylinder.

Furthermore, in the present application, as shown in FIG. 1, a second fixing recess 82 is defined on an end surface of the front seat 8 located in the accommodating space, and an opening of the third through-hole 81 is in turns formed in the bottom of the second fixing recess 82.

Furthermore, in the present application, as shown in FIGS. 1 and 2, the liquid diversion core 7 includes a core body 71 made of cotton material and a covering element 72 coated on the core body 71. In the present application, as the core body 71 is made of cotton material, the core body 71 has a good water absorbing property, which prevents leaking of liquid ink. The covering element 72 is a plastic film, and covers an outer surface of the core body 71 to determine the shape of the core body 71. The liquid diversion core 7 is snapped in the second fixing recess 82.

Furthermore, in the present application, as shown in FIGS. 1 and 3-5, the relaying pen core 6 passes through the first through-hole 31, wherein a rear end portion of the relaying pen core 6 is fixedly snapped in the fixing cover 111, and a front end portion of the relaying pen core 6 is inserted in a rear end portion of the liquid diversion core 7. Thus, the relaying pen core 6 can lead the liquid ink in the liquid storage space to the liquid diversion core 7.

The writing pen core 9 is inserted in a front end portion of the liquid diversion core 7, and can absorb the liquid ink in the liquid diversion core 7. Moreover, the writing pen core 9 passes through the third through-hole 81 and further extends out of the accommodating space. The pen cap 10 is detachably sleeved on the front seat 8, and is configured for protecting a front end portion of the writing pen core 9 extending out of the accommodating space.

Advantageously, in the present application, as shown in FIG. 1, a gap is formed between the relaying pen core 6 and the writing pen core 9, and the relaying pen core 6 is not contacted the writing pen core 9 directly; this design makes the liquid ink in the relaying pen core 6 injected into the liquid diversion core 7 at first, and then flowed into the writing pen core 9. In this way, a flow rate of liquid ink in the writing pen core 9 is kept constant, and the color of the handwriting is more uniform.

Furthermore, in the present application, a gap is formed between the relaying pen core 6 and an inner surface of the first through-hole 31, as shown in FIGS. 6-10. In FIGS. 6-10, the portion marked by oblique lines is a cross section of the relaying pen core 6, and a closed loop inscribed with the cross section of the relaying pen core 6 is a cross section of the first through-hole 31. In this case, the cross section of the first through-hole 31 is a polygon which has corner angles or rounded angles, and the gap between the relaying pen core 6 and the first through-hole 31 can form one or more channels. Thus, the air pressures inside and outside the liquid storage space can be kept balance, so that liquid ink in the liquid storage space can be led to the liquid diversion core 7 by the relaying pen core 6. Certainly, it is understood that the gap between the relaying pen core 6 and the first through-hole 31 of the air pressure balance plug 3 can't be too large; and when the gap is too large, the liquid ink in the liquid storage space can leak from the liquid storage space.

Figure 8:
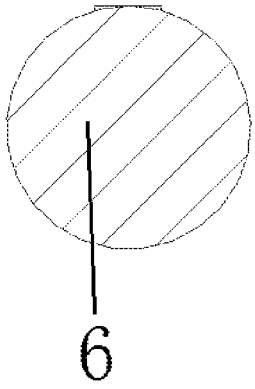
FIG. 8 is a schematic view of a third embodiment of a relaying pen core and a first through-hole adapted to each other of the present application.
Figure 9:
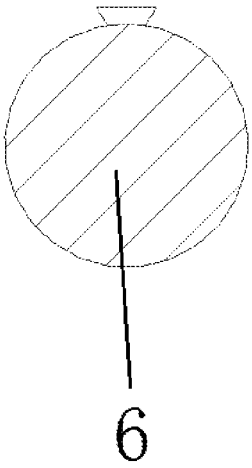
FIG. 9 is a schematic view of a fourth embodiment of a relaying pen core and a first through-hole adapted to each other of the present application.

Advantageously, in the present application, the section of the first through-hole 31 can be a polygon, a circle or any other special-shaped hole; and angles of the polygon can be corner angles or rounded angles (the radius precision of the rounded angles is more than R0.05). The section of the relaying pen core 6 is circular, and the section of the relaying pen core 6 is inscribed in the section of the first through-hole 31. Furthermore, by designing the section of the relaying pen core 6 and that of the first through-hole 31, a rectangular ventilation slot can be formed between the relaying pen core 6 and the first through-hole 31, as shown in FIG. 8. Furthermore, a trapezoidal ventilation slot can also be formed between the relaying pen core 6 and the first through-hole 31, as shown in FIG. 9.

Figure 3:
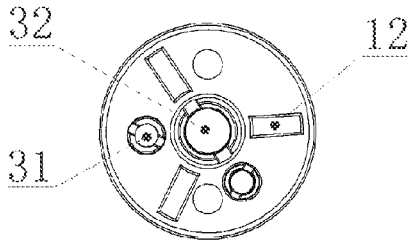
FIG. 3 is a schematic view of an air pressure balance plug of the reservoir type writing pen shown in FIG. 1.
Figure 4:
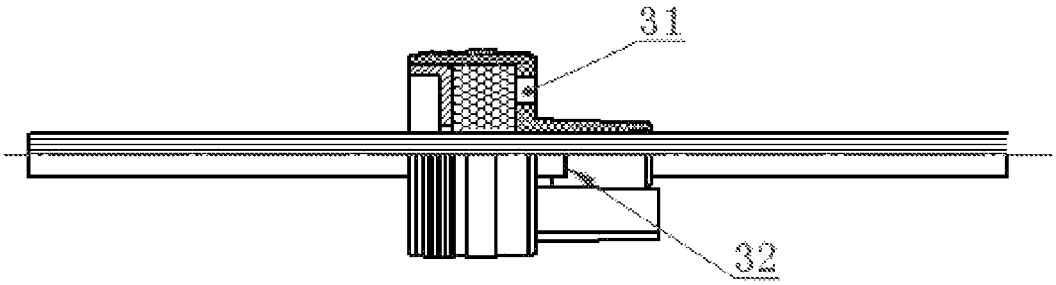
FIG. 4 is a structural schematic view of the air pressure balance plug shown in FIG. 3.
Figure 5:
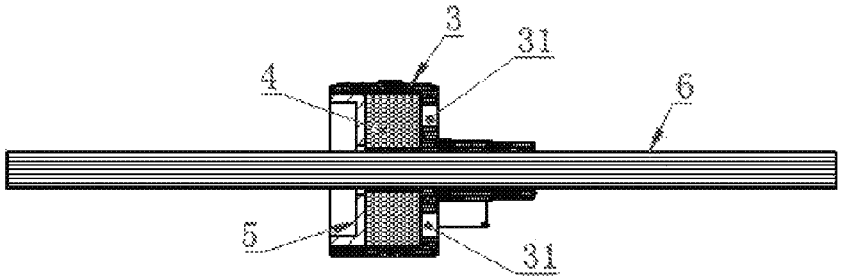
FIG. 5 is another structural schematic view of the air pressure balance plug shown in FIG. 3.
Figure 6:
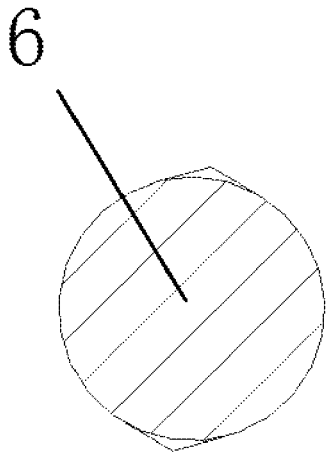
FIG. 6 is a schematic view of a first embodiment of a relaying pen core and a first through-hole adapted to each other of the present application.
Figure 7:
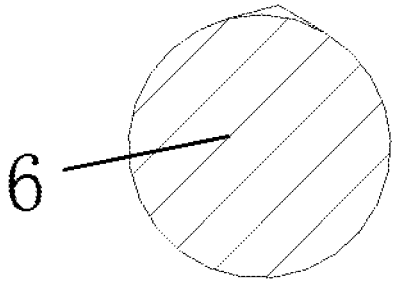
FIG. 7 is a schematic view of a second embodiment of a relaying pen core and a first through-hole adapted to each other of the present application.

Furthermore, in order to improve the liquid guiding effect of leading the liquid ink in the liquid storage space into the liquid diversion core 7, in the present application, as shown in FIG. 3, the air pressure balance plug 3 has two second through-holes 32. A nano breathing plate 4 is arranged between the ventilating core 5 and the air pressure balance plug 3, and the nano breathing plate 4 also covers the entire section of the second through-hole 32. In another embodiment, the ventilating core 5 is further contacted with the liquid diversion core 7 via the nano breathing plate 4, which further improves the liquid guiding effect. The nano breathing plate 4 is made of nano material processed by nano micro-pore technology. The porosity of the ventilating core 5 and that of the nano breathing plate 4 are 10%-90%, advantageously 25%-80%. Furthermore, the mean pore size of the ventilating core 5 and that of nano breathing plate 4 are 50 um-100 um, which can prevent the leaking of liquid ink when the inside and the outside of the liquid storage space are communicated with each other.

In the present application, the internal diameter of the first through-hole 31 is 0.5 mm-10 mm, and the internal diameter of the second through-hole 32 is 0.5 mm-10 mm.

Furthermore, in the present application, in order to prevent the liquid diversion core 7 from moving in the accommodating space, the reservoir type writing pen further comprises three blocking sheets 12. In this case, the three blocking sheets 12 are respectively inserted in the air pressure balance plug 3 and resisted with the liquid diversion core 7, such that the liquid diversion core 7 is fixed in the second fixing recess 82.

In the present application, the gap between the relaying pen core 6 and the writing pen core 9, the ventilating core 5 and the nano breathing plate 4 cooperate with each other to keep an air pressure of inside of the liquid storage space and that of outside of the liquid storage space balance, to realize the purpose of supplying the liquid diversion core 7 with liquid ink. When the writing pen is used, the liquid level of the liquid storage pipe 11 goes down, the negative pressure is increased, and outside air flows into the liquid storage pipe 11 via the ventilating core 5 and the nano breathing plate 4, in such a way that a free passage of air and an air pressure balance are achieved.

The present application adopts the gap between the relaying pen core 6 and the writing pen core 9, the ventilating core 5 and the nano breathing plate 4 to realize keeping the inner air pressure of the liquid storage space and the outside atmosphere pressure consistent. The writing pen of the present application has a simple structure, and the producing processes of the ventilating core have been matured, and the producing cost can be reduced greatly.

Furthermore, the writing pen core of the present application has various implementation models, such as a metal nib with a ball, a general pen refill, and so on. The nano breathing plate of the present application adopts material processed by nano interface technology, and uses super water-oil repellency nano material technology developed successfully on a surface of ventilating material with micropores. The nano breathing plate has a good lyophobicity and breathability.

Figure 10:
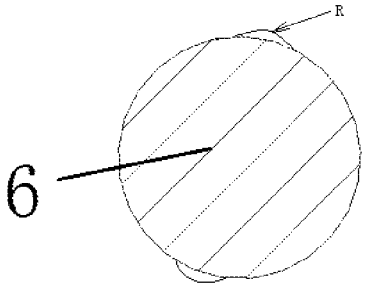
FIG. 10 is a schematic view of a fifth embodiment of a relaying pen core and a first through-hole adapted to each other of the present application.

In FIG. 10, the numbers of the flat hole, the first through-hole and the second through-hole can be one or more.

It is understood that those ordinary skills in the art can also make many modifications without breaking away from the subject of the present application and the protection scope of the claims. All these modifications belong to the protection of the present application.

What is claimed is:

1. A reservoir type writing pen having a micro-porous straight-liquid structure, comprising a writing pen core; wherein the micro-porous straight-liquid structure includes an air pressure balance plug, a liquid storage pipe configured for storing liquid ink, and a liquid guiding device configured for leading the liquid ink in the liquid storage pipe into the writing pen core; the liquid storage pipe includes a liquid storage cylinder and a fixing cover arranged on a rear end portion of the liquid storage cylinder; the air pressure balance plug is plugged in a front end portion of the liquid storage cylinder; a first through-hole and a second through-hole are respectively defined in the air pressure balance plug; the micro-porous straight-liquid structure further includes a ventilating core with micro-pores and configured for covering a section of the entire second through-hole to keep an air pressure of inside of the liquid storage pipe and that of outside of the liquid storage pipe balance; the liquid storage pipe, the air pressure balance plug and the ventilating core form a liquid storage space configured for storing the liquid ink;

the liquid guiding device includes a liquid diversion core and a relaying pen core; wherein the relaying pen core passes through the first through-hole, a rear end portion of the relaying pen core is further fixedly snapped in the fixing cover, and a front end portion of the relaying pen core is inserted in a rear end portion of the liquid diversion core, which is configured for leading the liquid ink in the liquid storage space into the liquid diversion core; the writing pen core is inserted in a front end portion of the liquid diversion core, which is configured for absorbing the liquid ink in the liquid diversion core;

a gap is formed between the relaying pen core and an inner surface of the first through-hole.

2. The reservoir type writing pen according to claim 1, wherein a section of the first through-hole is polygonal; a section of the relaying pen core is circular, and the section of the relaying pen core is inscribed in the section of the first through-hole.

3. The reservoir type writing pen according to claim 1, wherein the reservoir type writing pen further comprises a pen cylinder, a front seat and a rear seat; the front seat is a body of revolution, and a third through-hole is further defined in the front seat axially; the rear seat is columnar; the front seat is fixed on a front end portion of the pen cylinder, and the rear seat is fixed on a rear end portion of the pen cylinder, such that the front seat, the rear seat and the pen cylinder form an accommodating space; the liquid storage cylinder is a section of the pen cylinder; the fixing cover, the air pressure balance plug, the ventilating core, the liquid guiding device and the writing pen core are mounted in the accommodating space; the writing pen core passes through the third through-hole and further extends out of the accommodating space.

4. The reservoir type writing pen according to claim 3, wherein a first fixing recess is defined on an end surface of the rear seat located in the accommodating space, and the fixing cover is fixedly snapped in the first fixing recess.

5. The reservoir type writing pen according to claim 3, wherein a second fixing recess is defined on an end surface of the front seat located in the accommodating space; an opening of the third through-hole is formed in the bottom of the second fixing recess, and the liquid diversion core is fixedly snapped in the second fixing recess.

6. The reservoir type writing pen according to claim 5, wherein the reservoir type writing pen further comprises three blocking sheets, and the three blocking sheets are respectively inserted in the air pressure balance plug and resisted with the liquid diversion core.

7. The reservoir type writing pen according to claim 5, wherein a nano breathing plate is arranged between the ventilating core and the air pressure balance plug.

8. The reservoir type writing pen according to claim 7, wherein the ventilating core is further contacted with the liquid diversion core via the nano breathing plate.

9. The reservoir type writing pen according to claim 1, wherein the liquid diversion core includes a core body made of cotton material and a covering element coated on the core body.

10. The reservoir type writing pen according to claim 1, wherein the liquid diversion core includes a core body made of cotton material and a covering element coated on the core body.

11. The reservoir type writing pen according to claim 2, wherein the liquid diversion core includes a core body made of cotton material and a covering element coated on the core body.

12. The reservoir type writing pen according to claim 3, wherein the liquid diversion core includes a core body made of cotton material and a covering element coated on the core body.

13. The reservoir type writing pen according to claim 4, wherein the liquid diversion core includes a core body made of cotton material and a covering element coated on the core body.

14. The reservoir type writing pen according to claim 5, wherein the liquid diversion core includes a core body made of cotton material and a covering element coated on the core body.

15. The reservoir type writing pen according to claim 6, wherein the liquid diversion core includes a core body made of cotton material and a covering element coated on the core body.

16. The reservoir type writing pen according to claim 7, wherein the liquid diversion core includes a core body made of cotton material and a covering element coated on the core body.

17. The reservoir type writing pen according to claim 8, wherein the liquid diversion core includes a core body made of cotton material and a covering element coated on the core body.

* * * * *